United States Patent [19]

Amphoux

[11] Patent Number: 4,462,305

[45] Date of Patent: Jul. 31, 1984

[54] STATIC, DYNAMIC AND MECHANICAL ASPIRATOR FOR A GASEOUS FLUID

[76] Inventor: André Amphoux, 12, rue Jules César, Paris 12, France, 75012

[21] Appl. No.: 433,822

[22] Filed: Oct. 12, 1982

[30] Foreign Application Priority Data

Oct. 13, 1981 [FR] France ..... 81 19229

[51] Int. Cl.[3] ..... F23L 17/02

[52] U.S. Cl. ..... 98/78; 110/162

[58] Field of Search ..... 110/162, 159; 98/78, 98/79, 83

[56] References Cited

U.S. PATENT DOCUMENTS 2,348,950 5/1944 Anderson ..... 110/162 X 2,492,242 12/1949 Shaver ..... 98/78 X 3,924,605 12/1975 Weinman et al. ..... 110/162 X

FOREIGN PATENT DOCUMENTS 2374591 7/1978 France ..... 98/78

*Primary Examiner*—Edward G. Favors

*Attorney, Agent, or Firm*—Darby & Darby

[57] ABSTRACT

An aspirating device for the ejection of gases or fumes has dynamic primary and static secondary extraction means. The static secondary means has lower and upper elements configured in pseudo-frustoconical forms. The upper and lower elements are rigidly fixed to one another. The dynamic primary means are active or passive dependent on the desired level of flow of the ejected fluid.

7 Claims, 2 Drawing Figures

STATIC, DYNAMIC AND MECHANICAL ASPIRATOR FOR A GASEOUS FLUID

The invention relates to a static, dynamic and mechanical aspirator device, in particular for gases or fumes ejected from a stack or any sort of outlet with substantially vertical axis.

Aspirators in the form of turrets, composed of a hollow cap, and a pipe integral therewith, which is generally placed at the top of the stack, and means of extraction of a gaseous fluid, are already known. In general, these means of extraction are constituted by one or more blades rotating around the longitudinal axis of the turret, by means of a motor, for example, an electric motor. The means of extraction of the gaseous fluid can be constituted by blades or a centrifugal turbine, equipped, for example with a single-phase-two-speed motor, etc. Such turrets have several drawbacks. The first drawback is that the cap has borders with a concavity oriented downward, or inclined downward. The wind depending on its direction can be swallowed inside the cap and have a contrary effect on the device for acceleration of ejected gases, which causes a flow of ejected gases that is less than the desired flow. The same drawbacks are encountered in so-called "vertical-jet" turrets, when there is a downdraft.

Thus, depending on the direction of the wind, the flow of ejected gases can vary. Furthermore, there is a drawback in the fact that it is necessary to provide energy, such as electrical energy, to the motor so that it may cause the blades or the centrifugal turbine to pivot.

Also known are devices composed of a fan constituted by a first, upper, part formed of a conical, internal surface and a rounded external surface, and a second, lower part formed of a conical internal surface and a rounded external surface. The first and second part permit the extraction of the gaseous fluid in static fashion. Such a device is described, in particular, in U.S. Pat. Nos. 3,347,147 and 3,382,792. Moreover, in these devices, the bottom part contains a rotor (helix) actuated by a motor. This rotor is much larger in diameter than the diameter of the duct carrying the fluid to be extracted. As a result, this duct is cut at the level of the bottom part, and the fluid to be extracted spreads out inside the bottom part, i.e. between the conical internal surface and the rounded external surface. As a result, the extraction of the fluid is much less successful in spite of the presence of the rotor. Furthermore, this rotor is continually turning. Thus the flow of extracted gas is not constant, because the wind swallowed in the device can vary in velocity, as time goes on.

It is the object of the invention to remedy these drawbacks. More precisely, one object of the invention is to provide a device to aspirate gaseous fluids in such a way that the flow of ejected fluids will be adjusted to a desired level.

With this in mind, it proposes an aspirator device for a gaseous fluids, in particular of ejected gases or fumes, characterized by the fact that it includes, in combination, mechanical primary means of gaseous fluid extraction, and static secondary means of gaseous fluid extraction cooperating in such a way that the flow of extracted gaseous fluid will be adjusted at a predetermined level.

More particularly, the device has, in combination, mechanical primary means of gaseous fluid extraction, static secondary means of gaseous fluid extraction, control means that can shift the mechanical means from the active state to the passive state and vice-versa, and means of adjustment acting on the mechanical means to keep the nominal flow of extracted gaseous fluid at a minimal level.

The mechanical primary means of fluid extraction are constituted by a centrifugal or helicoid turbine moved by a motor.

The static secondary means are constituted by a superposed and coaxial lower element and upper element, rigidly fixed to one another, a certain distance apart, by at least one crossbrace, the lower element having a lower base and a lower cap, each of them having an upper base and upper cap, each of them having a pseudo-frustoconical form, the base and the cap of the lower element being traversed coaxially by a pipe which is integral with them, and opens into the space comprised between the two elements, through an outlet orifice for the gaseous fluids.

The means of control and adjustment of the mechanical primary means are composed of means of detection of the true level of the control parameter, such as the pressure of the wind around the device, or the pressure prevailing in the interior of the device.

means of comparison of this true level and of a fixed level.

means emitting a control signal to the mechanical primary means, as a function of the relative position of the true level relative to the limit level.

The mechanical primary means of fluid extraction are active as long as the flow of ejected fluid has not reached the desired minimal limit level, and passive when the flow has reached this minimal level.

The device according to the invention therefore permits a saving of energy which is becoming scarcer and more expensive today. As a matter of fact, devices of the venturi type containing a lower element and an upper element, each constituted by a cap and a base make it possible to further increase the flow of fluid extracted by the mechanical means. Furthermore, when the wind has sufficient force, the mechanical means are inactive, making for economy.

The invention will be better understood on viewing the attached drawings in which.

The gaseous fluid aspirator device contains, in combination, a pipe 1, and a circular, hollow lower element 2 with which it is integrated.

The device according to the invention is constituted by mechanical primary means 17 of fluid extraction, static secondary means of fluid extraction constituted by a device of the venturi type containing a lower element 2 and an upper element 3.

Figure 1:
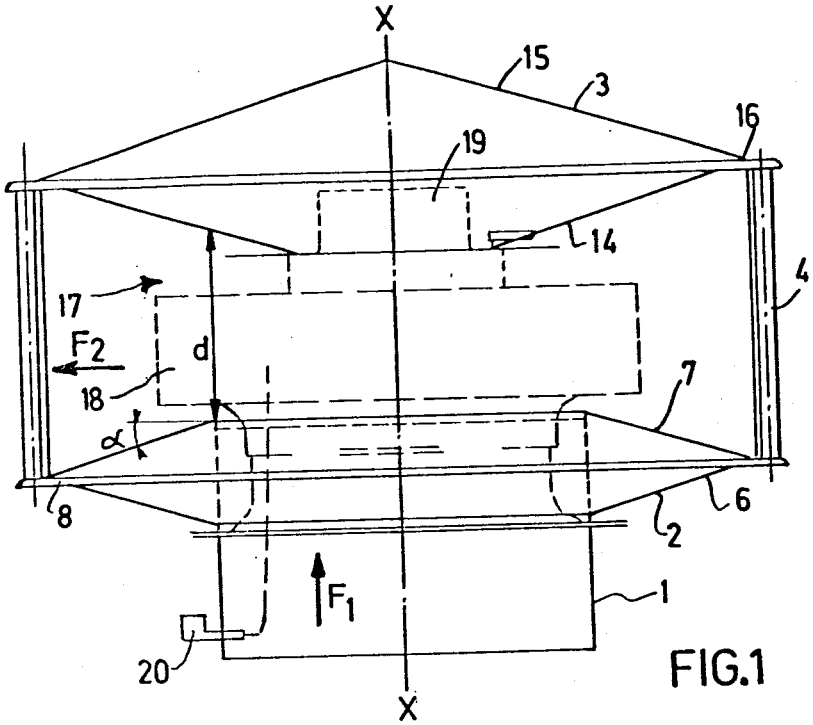
FIG. 1 is a schematic view of the device according to the invention, the mechanical means of fluid extraction being a centrifugal turbine.

The primary means 17 are constituted more particularly, by a centrifugal turbine 18 (FIG. 1) merely schematized since it does not in itself form part of the invention, and is within the grasp of the man of the art. Turbine 18 is actuated by a motor 13, such as a two-speed single-phase or explosion-proof motor, etc.

It also contains secondary means of extraction constituted by a hollow and circular upper element 3 placed at a certain distance from the lower element 2 by one or more rods 4 or crossbraces. Lower element 2 is constituted by a lower base 6 and a lower cap 7, each of them having a pseudo-conical form with axis XX, rigidly fixed to one another along two common large bases 8 of circular contour. Pipe 1 passes coaxially through the lower base 6 and the lower cap 7.

The upper element 3 is constituted by an upper base 14 and an upper cap 15, each of them having a pseudo-conical form. These two elements are combined with one another along their large base of circular contour 16. More particularly, the lower base 6 and the lower cap 7 have the form of a truncated cone. The diameter of the small base of these truncated cones is substantially equal to the diameter of the pipe 1. Moreover, the upper base 14 also, preferably, has the form of a truncated cone, in the case of the centrifugal turbine, and a conical form in the case of the helical turbine. The generatrixes of the cones are inclined relative to a line perpendicular to the longitudinal axis XX of the device at an angle alpha comprised between 10° and 45°, and preferably 17° and 20°. The diameter of the common, large bases 8 and 16 is comprised between 2 to 3.5 times the diameter of pipe 1, and preferably 2.5. The interval d between lower cap 7 and upper base 14, calculated at the position of the projection of the generatrix of pipe 1, is comprised between 0.35 and 0.8 times the diameter of pipe 1, for example 0.5.

The crossbraces are joined to one another by a mesh grid, not shown, forming a cylindrical belt with axis XX.

Centrifugal turbine 18 aspirates the gaseous fluids issuing from pipe 1, in a direction-parallel to the longitudinal axis XX of the device, in a direction oriented toward the interior of the device (arrow F 1) and ejects the gases in a direction perpendicular to axis XX, oriented toward the exterior of the device (arrow F 2). Moreover, the secondary means of extraction constituted by the venturi 2, 3 eject the gases in the direction of arrow F2.

The device includes means of control and adjustment 20 of mechanical primary means 17, composed:

- of means of detection of the true level of the control parameter, such as the pressure of the wind around the device, or the pressure prevailing in the interior of the device,
- of means of comparison of this true level and of a fixed limit level,
- of means emitting a control signal to the mechanical primary means as a function of the relative position of the true level relative to the limit value.

The control means 20 are constituted, for example, by a sensor or pressostat. They are connected to motor 19 to which they send pulses, such as electrical pulses.

Figure 2:
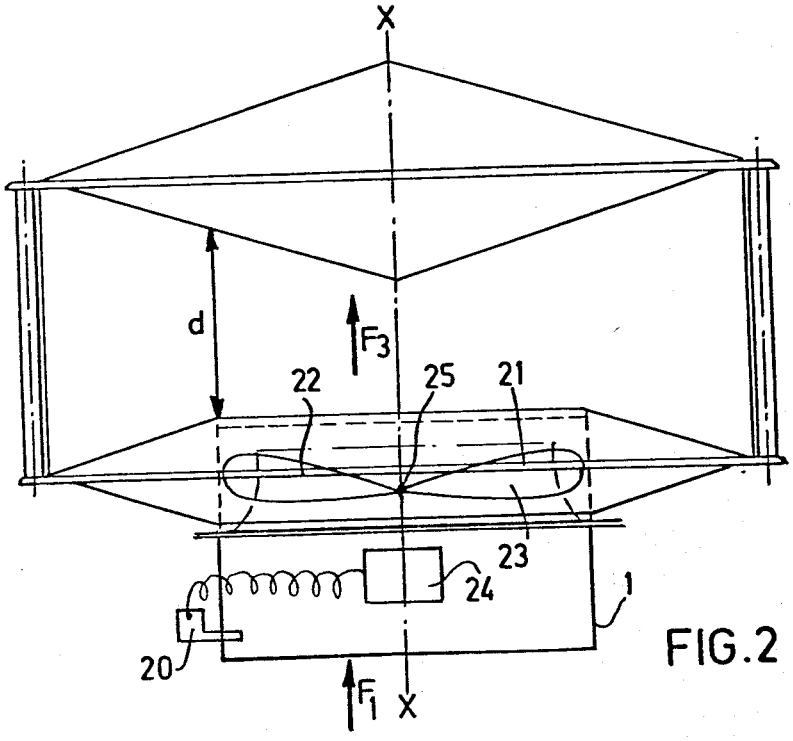
FIG. 2 is a schematic view of the device according to the invention, the mechanical means being constituted by a helical turbine.

A second embodiment of the invention is represented in FIG. 2. The primary means of increasing the flow 17 are constituted by a rotor (helix) 21 with two blades 22 and 23, for example, that can pivot around the longitudinal axis XX of the device. Blades 22 and 23 are moved by a motor 24 connected electrically to control means 20 inside pipe 1. The blades 22 and 23 are disposed inside pipe 1 so that the gaseous fluid will penetrate only into duct 1 and not into the part situated between duct 1 and lower base 6 and lower cap 7 of the lower element. The action of the venturi therefore is not diminished by the presence of the rotor blades. The blades 22, 23 of the rotor are situated in duct 1, at the level of the lower element 2.

Since means 17 are constituted by a rotor, the latter ejects the fluids in a direction parallel to axis XX.

If the means 17 (i.e. the centrifugal turbine) eject the fluids in a direction perpendicular to axis XX, they are placed between elements 2 and 3 so that the action of the mechanical primary means of extraction 17 and secondary means 2 and 3 will work in the same direction.

When means 17, 18, (i.e. the rotor 22, 23) eject the fluids in a direction parallel to the longitudinal axis XX of the device, they are placed in the interior of pipe 1. They will therefore increase the flow of fluid through pipe 1, while means 17, which eject the fluids in a direction perpendicular to axis XX, increase the flow of gases issuing from pipe 1.

The device works as follows:

When the wind is insufficient for obtention of a desired flow of ejected fluid, the primary means 17 are active, i.e. motors 19, 24 are running. The flow of fluid issuing from primary means 17 is increased by secondary means 2,3.

When the wind is of sufficient strength, the flow of fluid issuing from the device reaches the minimum desired level, and if it exceeds this, the primary extraction means 17 are then passive. Motors 19, 24 are not running, the control measuring device 20 then sending an electric control signal to these motors. The primary means 17, if they are constituted by a helical turbine 21, are active, but are driven by the ascending velocity created by the partial vacuum produced by the venturi system 2, 3. Rotor 21 rotates around its axis 25.

The advantages of application of the venturi to the mechanical means 17 can be summarized:

(a) for the centrifugal turbine, in higher efficiency for the latter, procured by an improved penetration of the gaseous fluids extracted in the atmosphere, with the assurance of always obtaining a predetermined nominal flow.

Hence, with equal motors, in comparison with known devices, correspondingly larger flows are obtained.

(b) for the helical turbine, likewise, a better penetration of the gaseous fluids is obtained, for which, with equal motor power there are greater flows, and furthermore there is the possibility of extracting naturally, without running the motor, once the wind velocity is sufficient to extract the predetermined nominal flow.

I claim:

1. Aspirator device for a gaseous fluid, in particular for ejected gases or fumes, comprising mechanical primary means for fluid extraction, static secondary fluid extraction means, and means for control and adjustment, which can make the primary means active or passive when the flow of gaseous fluid reaches a predetermined level, characterized in that the static secondary means are constituted by a lower element and an upper element which are superposed and coaxial, and rigidly fixed to one another, a certain distance apart, by at least one crossbrace, the lower lower element having a lower base and a lower cap, each one of them having a pseudo-frustoconical form, the upper element having an upper base and an upper cap each one having a pseudo-frustoconical form, the base and cap of the lower element being crossed coaxially by a pipe integral with the latter, which opens into the space between the lower and upper elements through an outlet orifice for gaseous fluid, and further characterized in that the mechanical primary means of extraction are active when the desired flow of ejected fluid is below a minimal desired level, and are passive when the flow reaches the minimal level.

2. Device according to claim 1, characterized by the fact that the mechanical primary, flow means are constituted by a centrifugal turbine driven by a motor, the centrifugal turbine being placed between the lower and upper elements coaxially to the device.

3. Device according to claim 1, characterized in that the mechanical primary means are constituted by a helical turbine having at least two blades pivoting around an axis mounted for rotation coaxially with the lower and upper elements, the blades being moved by a motor and placed in the interior of the pipe.

4. Device according to any of claims 1, 2 and 3, characterized in that the means of control and adjustment of the mechanical primary means comprise:

means of detection of the true level of the control parameter, means of comparison of this true level and a fixed limit level, means of emission of a control signal to the mechanical primary means, as a function of the relative position of the true level compared to the limit level.

5. Device according to any one of claims 1 4 and 5, characterized in that when the means are constituted by a centrifugal turbine, the upper base has the form of a truncated cone.

6. Device according to any of claims 1, 2 and 3, characterized in that when the mechanical primary means are constituted by a helical turbine, the upper base has the form of a cone, and the blades of the helix are situated in the duct at the level of the lower element.

7. Device according to any of claims 1, 2 and 3, characterized in that the interval between the lower cap and the upper base, calculated at the position of the projection of the generatrix of the pipe, is between 0.35 and 0.8 times the diameter of the pipe.

* * * * *